US005630332A

United States Patent [19]

Aldieri et al.

[11] Patent Number: 5,630,332

[45] Date of Patent: May 20, 1997

[54] HYBRID PLUG LOCK

[75] Inventors: Raymond Aldieri, Plantsville; Thomas J. DiVito; Edward F. Humphrey, both of Southington, all of Conn.

[73] Assignee: Kaba High Security Locks Corporation, Southington, Conn.

[21] Appl. No.: 479,759

[22] Filed: Jun. 7, 1995

[51] Int. Cl.[6] ..... E05B 17/04

[52] U.S. Cl. ..... 70/379 R; 70/DIG. 23; 70/DIG. 42

[58] Field of Search ..... 70/379 R, 372, 70/373, 374, 375, 376, 377, 391, 427, 208, 379 A, 380, DIG. 42, DIG. 23, DIG. 24

[56] References Cited

U.S. PATENT DOCUMENTS

| | | | |
|---|---|---|---|
| 1,724,025 | 8/1929 | Jacobi | 70/379 R |
| 2,275,362 | 3/1942 | Golden et al. | 70/379 R |
| 3,299,678 | 1/1967 | Spencer | 70/208 |
| 3,438,227 | 4/1969 | Wolniak | 70/208 |
| 4,715,201 | 12/1987 | Craig | 70/369 |
| 5,212,972 | 5/1993 | Kincaid et al. | 70/208 |

*Primary Examiner*—Steven N. Meyers
*Assistant Examiner*—Donald J. Lecher
*Attorney, Agent, or Firm*—Chilton, Alix & Van Kirk

[57] ABSTRACT

A lock, particularly well suited for installation in the T-handle of a vending machine or the like, which acts as a spring latch during opening and as a deadbolt in the locked position. The lock has a cylinder with a rotatable plug supporting a drive pin, the drive pin being parallel to and offset from the axis of plug rotation. The drive pin engages a ramped guide groove in a spring biased bolt, the guide groove being configured to return the drive pin to a position where it is in registration with, but displaced from, its starting position after a complete rotation of the plug.

11 Claims, 5 Drawing Sheets

HYBRID PLUG LOCK

BACKGROUND OF THE INVENTION

1. Field of the Invention

The present invention relates to enhancing the security of machines which must be periodically opened for routine service and, particularly, to increasing the difficulty of obtaining unauthorized access to the interior of machines which include a cache of currency. More specifically, this invention is directed to a lock for use in the vending industry and, especially, to an improved "plug lock" which may be installed in a T-handle of a vending machine or the like. Accordingly, the general objects of the present invention are to provide novel and improved methods and apparatus of such character.

2. Description of the Prior Art

While not limited thereto in its utility, the present invention is particularly well suited for use in the vending industry. Many "vending" machines, and as used herein the term "vending machine" includes machines which collect a fee and/or make change, are provided with a T-handle which is employed to gain access to the interior of the machine for, by way of example, restocking. Such T-handles are fabricated from a high strength material and, in the normal operating position, are seated in a complementary shaped recess in the housing or outer casing of the associated machine. The T-handle has a tubular shaft portion, which opens through the cross-member, which receives a lock cylinder, i.e., a "plug lock". The T-handle shaft, in turn, is received in a tubular housing and the latch member of the lock engages an aperture in this housing in the locked state. When the plug lock is operated to the unlocked position, by means of a properly bitted key, the latch member will be disengaged from the housing and the thus released T-handle will be driven out of its recess by a biasing spring. The operator, gaining access to the T-handle, may then rotate the handle thereby causing a screw threaded extension rod coupled to the shaft thereof to become disengaged from a complementary threaded receiver located within the machine. When the rod is fully disengaged from the receiver, the access door to the machine may be opened.

Two different types of plug lock have previously been installed in T-handles of vending machines. A first type of prior art plug lock is basically a spring loaded latch mechanism which allows the operator to employ a key to unlock the device and then remove the key. When the door is closed, the latch member may be reengaged with a receiver in the housing simply by pushing the T-handle to its final recessed, i.e., normal locked, position without reinsertion of the key. This ability to lock the machine without the use of a key is a convenience and generally ensures that service personnel will not accidentally leave the machine unlocked. The described self-latching ability results from the fact that the spring biased latch member can be depressed when the cylinder of the plug lock is in either the locked or unlocked state. Such latch type plug locks, however, present a significant security problem. That is, latch-type plug locks can be defeated simply by drilling a small hole in the machine, inserting a stiff wire through the drilled hole and unlocking the machine by using the wire to depress the latch even though the cylinder is in the locked state.

The other type of previously employed "plug lock" utilizes a deadlocking bolt in lieu of the spring latch. A deadlocking bolt has the obvious advantage that, when the cylinder is in the locked position, the bolt cannot be depressed, i.e., the bolt can only be disengaged by using a properly bitted key. While the use of a deadlocking bolt affords enhanced security against defeat by surreptitious means, as discussed above, it requires deliberate locking with a key when the access door is closed and the T-handle pushed into its receiving recess. This is an inconvenience and presents the potential for inadvertent failure to relock. For example, in the case of a badly worn locking mechanism, it is possible for the T-handle to appear to be in the locked position even though the deadlocking bolt has not been engaged through operation of the key.

SUMMARY OF THE INVENTION

The present invention overcomes the above briefly discussed and other deficiencies and disadvantages of the prior art and, in so doing, provides a novel hybrid lock which acts as a spring latch during opening and closing of the T-handle but, when in the locked position, has a deadlocking bolt which can only be moved to the unlocked position through the use of a proper key.

A lock in accordance with the present invention includes a spring-loaded drive pin coupled to, and rotatable with, the cylinder plug. This drive pin functions as a drive mechanism for a unique bolt. The bolt is provided with a body having a ramped groove which guides the bolt as the key rotates the cylinder plug. In the deadlocked position, the drive pin is located in the deepest portion of the guide grove. The bolt is spring biased toward the locked position. As the drive pin travels along the guide groove, in response to rotation of the operating key, the bolt will initially be driven against the spring bias to the unlocked position. The guide groove will, when the key has been turned through a complete rotation, lead the drive pin to a ramped position which is above the locked position. Accordingly, when the bolt moves outwardly upon realignment with the receiving aperture therefore in the housing, as the T-handle is returned to its recessed position, the drive pin will be pushed back into the deepest part of the guide groove.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in several figures and in which.

DESCRIPTION OF THE DISCLOSED EMBODIMENT

Figure 1:
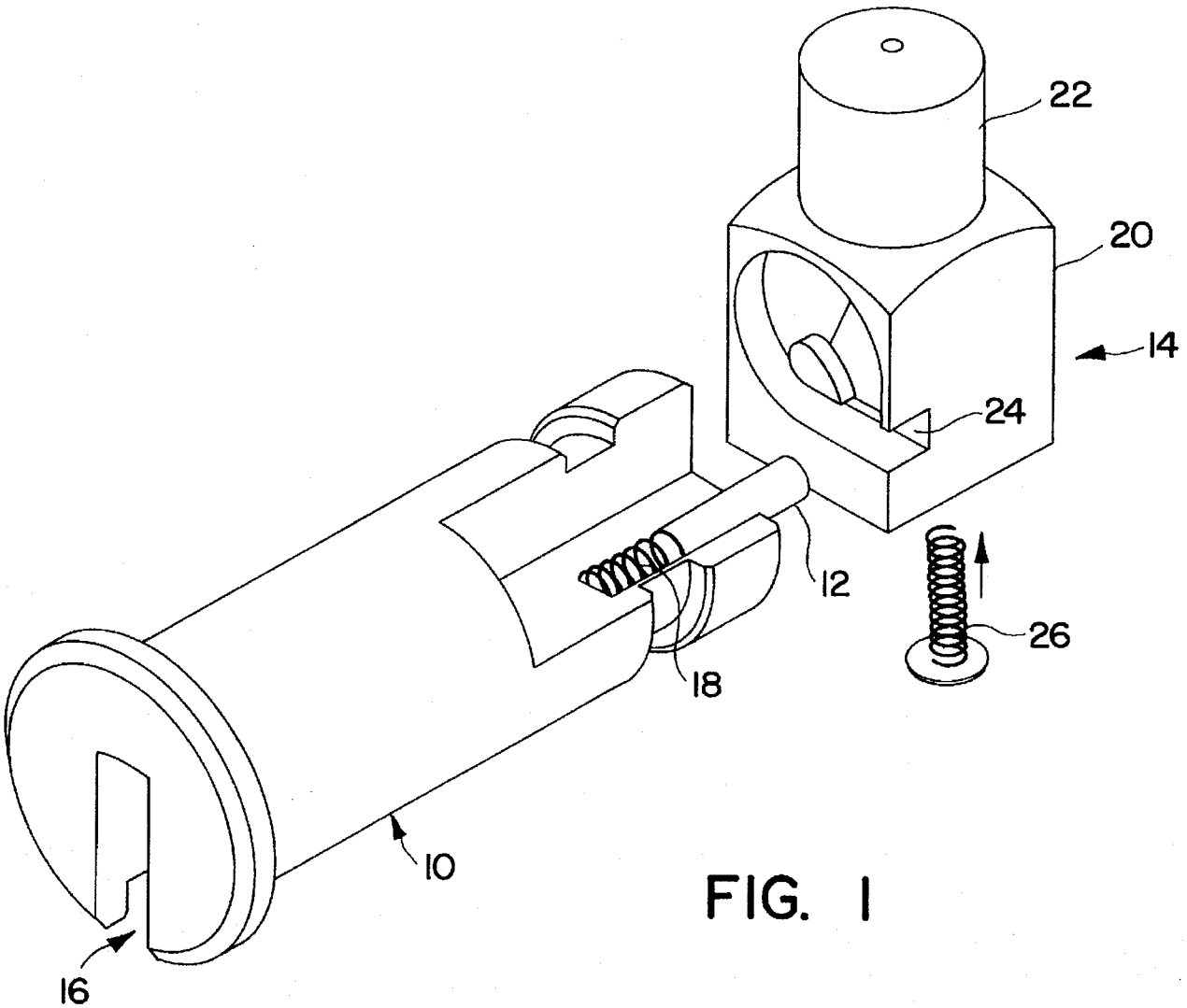
FIG. 1 is a partial perspective view which depicts the primary components of a hybrid plug lock in accordance with the present invention, FIG. 1 also being in part a schematic illustration.

Referring to the drawings, a hybrid plug lock in accordance with the present invention includes three major components. These components are a cylinder plug, indicated generally at 10, a spring-loaded drive pin 12 and a deadlocking bolt, indicated generally at 14. In the assembled lock, plug 10 will cooperate, in the conventional manner, with a cylinder shell 13 to define a cylinder, i.e., a complete operating lock consisting of the plug, shell, tumblers, springs, plug retainer and all other necessary operating parts. To facilitate understanding of the invention, plug 10 and shell 13 have been shown schematically. In the typical operating environment, the cylinder will be removably received in a bore provided therefor in the tubular shaft of a T-handle. Plug 10 will, of course, define a keyway 16 which receives the operating key. Insertion of a key having the proper profile, i.e., cross-sectional shape, and bitting into keyway 16 will result in displacement of the bottom pins of the cylinder so as to align all of the pin tumbler surfaces with a shear line between the plug and shell thus permitting rotation of the plug relative to the shell.

In accordance with the invention, plug 10 is provided with a longitudinal bore having an axis which is parallel to the axis of rotation of plug 10. The drive pin 12 is received in this longitudinal bore. A compression spring 18, which biases drive pin 12 in the direction of bolt 14, is also received in the bore.

Bolt 14 includes a body portion 20 from which a cylindrical latch 22 extends. The body portion 20 of bolt 14 is provided with a ramped, generally elliptical guide groove 24 which is engaged by the end of drive pin 12. The latch 22 has an axis which is oriented generally transversely with respect to the axis of rotation of plug 10. Bolt 14 is resiliently biased, by a compression spring indicated schematically at 26, in the direction of the axis of latch 22.

Figure 2:
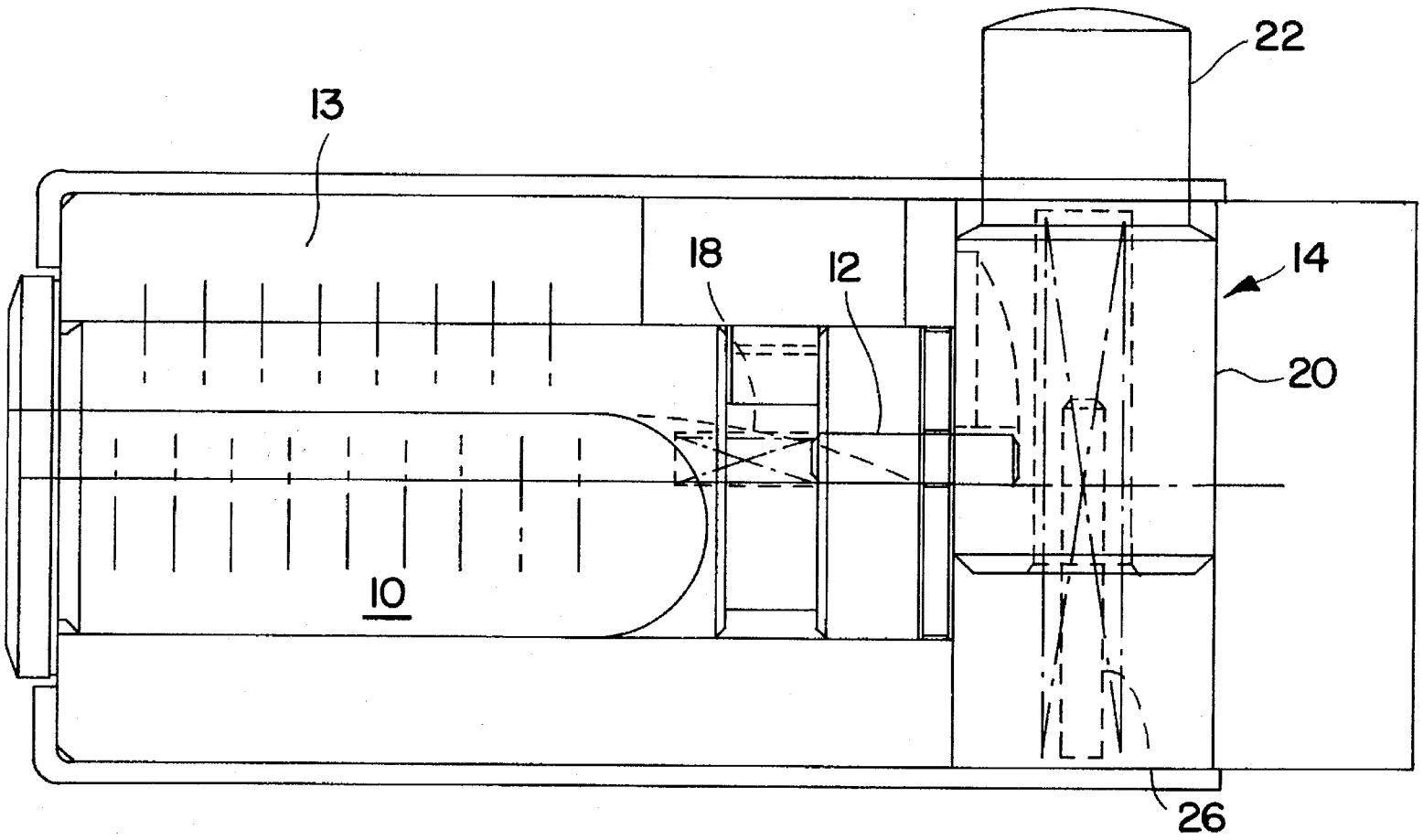
FIG. 2 is a schematic, side elevation view of a hybrid plug lock in accordance with the invention.
Figure 3:
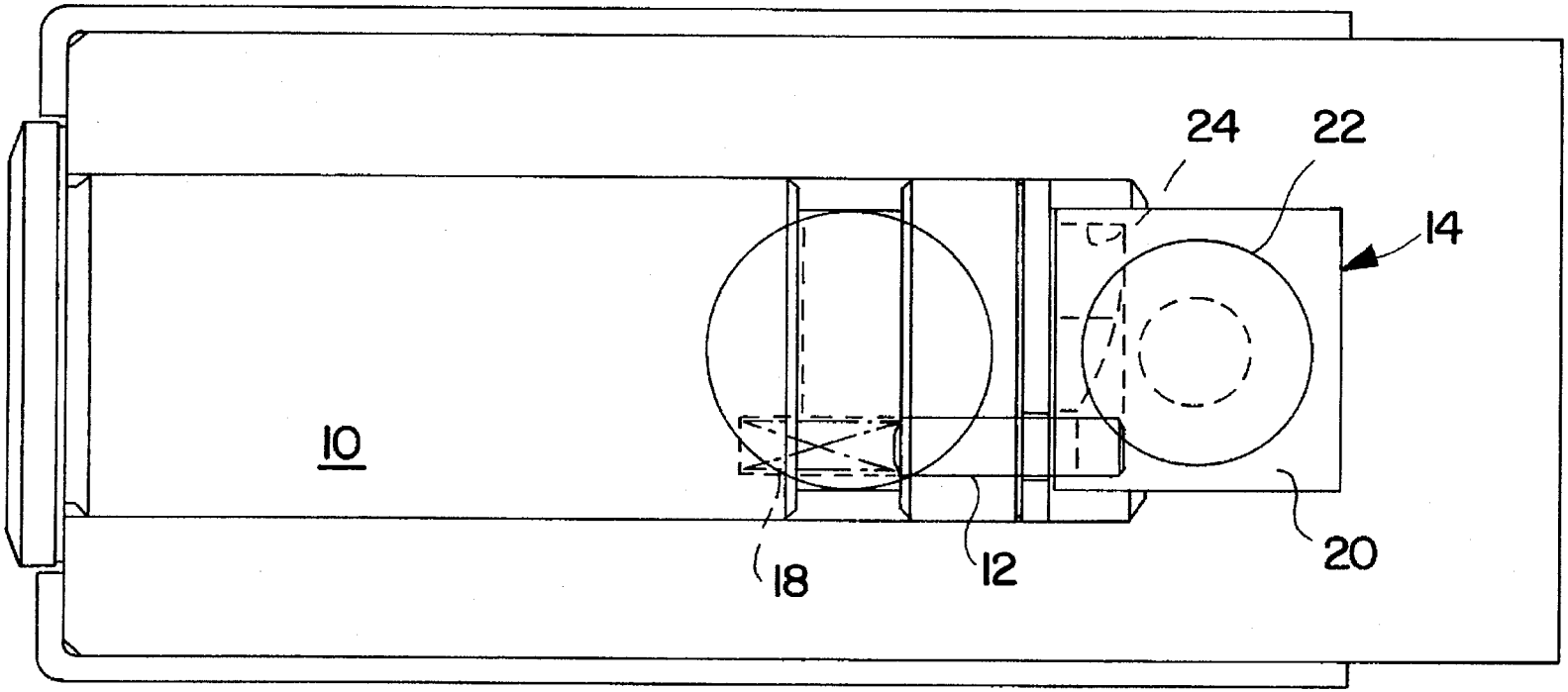
FIG. 3 is a schematic top plan view of the lock of FIG. 2.

Bolt 14 is received in a rectangular channel provided in an extension of shell 13 as may be seen from FIGS. 2 and 3.

Figure 4:
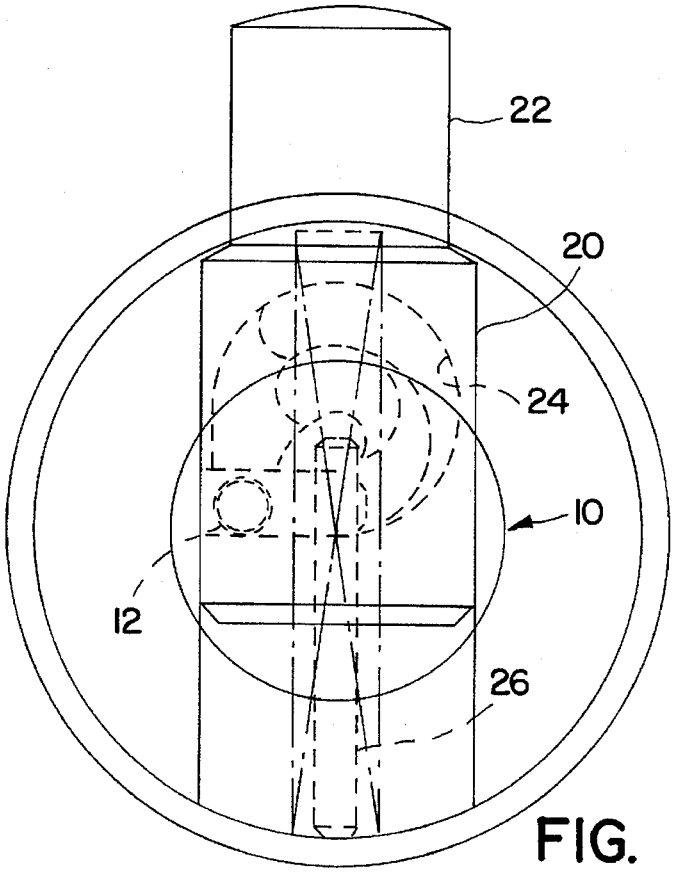
FIGS. 4–7 are schematic views, looking from the right end as the lock is depicted in FIGS. 1–3, which illustrate in step-wise fashion the operation of the disclosed embodiment of the invention.

FIG. 4 illustrates the lock of FIGS. 1–3 with the cylinder locked, i.e., with the latch 22 engaged in a complementary opening in the tubular housing, not shown, which receives the tubular shaft of the T-handle, and with the key removed. In the state depicted in FIG. 4, the T-handle will be pushed into its receiving recess so as to be essentially flush with the outer surface of the machine in which installed. In the FIG. 4 state of the lock, the free end of drive pin 12 is in the deepest portion of guide groove 24 and the bolt 14 is deadlocked.

Figure 5:
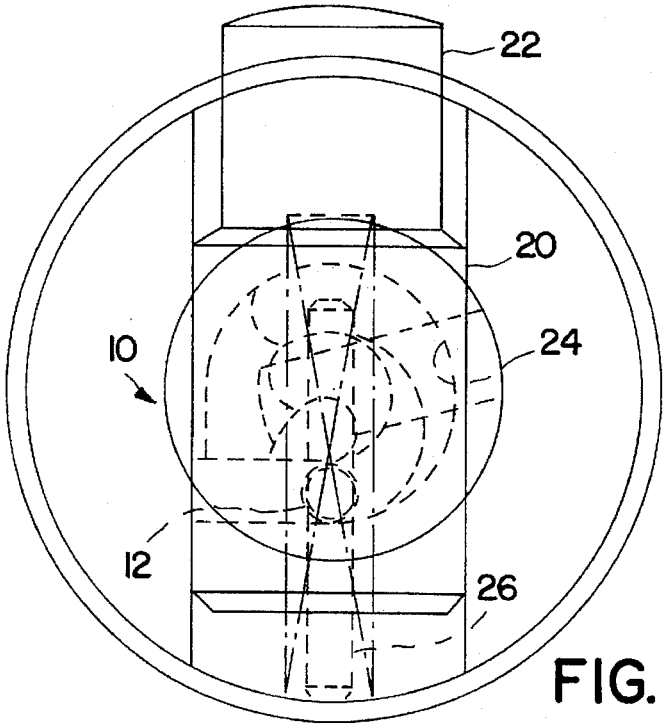

FIG. 5 depicts the state of the lock after a proper key has been inserted in keyway 16 and plug 10 rotated through an angle of approximately 100°. As a result of the cooperation between drive pin 12 and guide groove 24, the rotation of plug 10 will force bolt 14 inwardly, against the bias of spring 26, to a point where latch 22 will be disengaged from its receiving aperture in the housing of the handle thus permitting the T-handle to "pop out", i.e., the biasing spring behind the T-handle will drive the handle with the cylinder subassembly forward. The handle will thus, with the lock in the condition depicted in FIG. 5, be in a position for rotation whereby the threaded rod coupled thereto can be unscrewed from its receiver thereby permitting opening of the door of the machine. In the FIG. 5 position, the bolt is not fully depressed, i.e., the T-handle will be released while a portion of the latch 22 remains exposed. When the handle pops out, the bolt will be retained in the position shown in FIG. 5 by contact between the end of latch 22 and the interior of the tubular housing which receives the T-handle.

Figure 6:
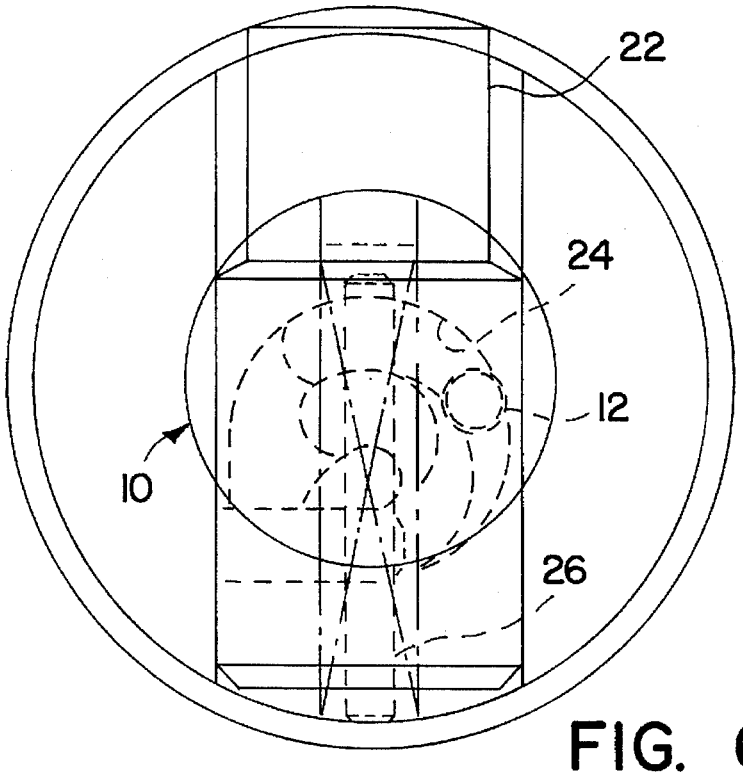

FIG. 6 depicts the state of the lock when the plug has been rotated 180°. In the condition depicted in FIG. 6, the cylinder may be removed. The lock may thus be "rekeyed" by employing a suitable tool to further depress the bolt, which will be accessible through the tubular handle shaft in the space between the handle and the base of the handle receiving recess, so that it does not extend outwardly beyond the outer diameter of the cylinder.

Figure 7:
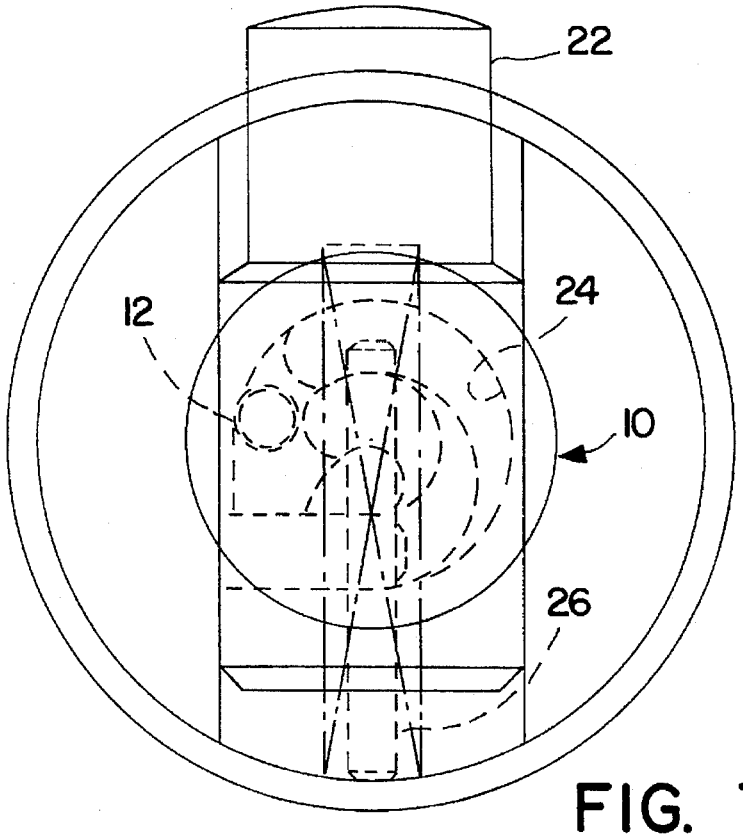

FIG. 7 depicts the lock when the key has made a complete rotation, i.e., has been turned through 360°. In the position of FIG. 7, the drive pin 12 will have climbed to the top of the ramped portion of guide groove 24. Also in the FIG. 7 position, the key may be removed from the cylinder. Accordingly, when rotated to the position shown in FIG. 7, the cylinder will be in the locked position, i.e., the drive pin 12 will have returned to the position shown in FIG. 4. As shown in FIG. 7, the T-handle is still in the popped out position and the bolt is retained in the position shown as a result of contact between the end of latch extension 22 and the inner diameter of the tubular T-handle shaft. When the handle is pushed to the locked position, the bolt will be returned to alignment with the receiving aperture for latch 22 in the housing of the T-handle and the bolt will thus be driven outwardly by spring 26. Latch 22 will now reengage the housing of the handle and spring 18 will drive pin 12 into the end portion of guide groove 24 thus deadlocking the assembly.

It is to be noted that the travel of the drive pin 12 along the guide groove 24 as the key is turned to operate the cylinder leads to a ramped position which is above the final locked position. Thus, as described above, when the bolt moves outwardly as the handle is closed, the drive pin is pushed into the bottom, i.e., the deepest portion, of guide groove 24 creating a deadlocked position.

It should also be noted that spring 26, in the disclosed embodiment, is not cylindrical but, rather, is elongated at the end thereof disposed away from bolt 14. The enlargement may be a single coil, or the spring may be at least partly conically shaped. The enlarged end of spring 26 assists in keeping the spring in direct alignment with the bolt as the bolt rises and falls during cylinder operation.

While a preferred embodiment has been shown and described, various modification and substitutions may be made thereto without departing from the spirit and scope of the invention. Accordingly, it is to be understood that the present invention has been described by way of illustration and not limitation.

What is claimed is:

1. A deadlocking latch assembly comprising:

a cylinder, said cylinder having a shell and a plug, said plug having oppositely disposed first and second ends and defining a keyway which is accessible from said first end, said plug being rotatable relative to said shell about an axis from a locked to an unlocked condition upon insertion of a properly bitted key in said keyway;

bolt means, said bolt means being supported for reciprocal motion in a direction which is generally transverse to said axis of plug rotation, the location of said bolt means along said axis of plug rotation being fixed, said bolt means including:

a body portion, said body portion having a first side which faces said plug second end;

a guide groove in said first side of said bolt means body portion, said guide groove extending smoothly and continuously from a first end to a second end, said guide groove first end being displaced from said plug second end a greater distance than said guide groove second end, said guide groove first and second ends being angularly adjacent; and a latch member extending from said bolt means body portion generally in the direction of bolt means movement for engaging a stationary receiver;

drive pin means for coupling said cylinder to said bolt means, said drive pin means being supported for rotation with said cylinder plug, said drive pin means extending from said plug second end for engagement with said guide groove, said drive pin means having an axis which is parallel to and offset from said axis of plug rotation, said drive pin means being positioned in said guide groove adjacent said first end thereof with said cylinder in the locked condition to define the deadlocked state of said latch assembly, rotation of said cylinder plug in a first direction through an angle of 360° from the locked position causing said drive pin means to travel in said guide groove from said first to said second end thereof and beyond said second end to a position where said drive pin means is in registration with said guide groove first end; and means for resiliently biasing said bolt means outwardly with respect to said axis of plug rotation and toward the stationary latch member receiver.

2. The latch assembly of claim 1 wherein said drive pin means comprises:

an elongated drive pin having oppositely disposed first and second ends, at least said first end of said drive pin being sized and shaped to engage said guide groove; and spring means acting on said second end of said drive pin for resiliently urging said drive pin against said bolt means.

3. The latch assembly of claim 1 wherein said bolt means latch member is integral with said bolt means body portion.

4. The latch assembly of claim 2 wherein said bolt means latch member is integral with said bolt means body portion.

5. The latch assembly of claim 1 wherein said guide groove has a ramped portion intermediate said guide groove first and second ends, said ramped portion leading from a first plane oriented generally transversely to said axis of plug rotation in which said guide groove first end is located to a second plane oriented generally transverse to said axis of plug rotation in which guide groove second end is located.

6. The latch assembly of claim 5 wherein said drive pin means comprises:

an elongated drive pin having oppositely disposed first and second ends, at least said first end of said drive pin being sized and shaped to engage said guide groove; and spring means acting on said second end of said drive pin for resiliently urging said drive pin against said bolt means.

7. The latch assembly of claim 6 wherein said bolt means latch member is integral with said bolt means body portion.

8. The latch assembly of claim 2 wherein initial rotation of said cylinder plug in said first direction from the locked position will cause said bolt means to move in opposition to the force of said biasing means whereby said latch member will be retracted from the receiver and wherein registration of said drive pin with said guide groove first end will, when said latch member is aligned with the receiver, result in said spring means forcing said drive pin first end into said guide groove first end to thereby deadlock said assembly.

9. The latch assembly of claim 8 wherein said guide groove has a ramped portion intermediate said guide groove first and second ends, said ramped portion leading from a first plane oriented generally transversely to said axis of plug rotation in which said guide groove first end is located to a second plane oriented generally transverse to said axis of plug rotation in which guide groove second end is located.

10. The latch assembly of claim 9 wherein said bolt means latch member is integral with said body portion and has a generally cylindrical shape with a rounded free end.

11. The latch assembly of claim 8 wherein said bearing means comprises an elongated spring, said elongated spring having a first end in contact with said bolt means and a second end supported against said cylinder shell, said second end having a greater diameter than said first end.

* * * * *